US008182051B2

(12) United States Patent
Laible et al.

(10) Patent No.: US 8,182,051 B2
(45) Date of Patent: May 22, 2012

(54) HOUSING FOR A HOUSEHOLD APPLIANCE

(75) Inventors: Karl-Friedrich Laible, Langenau (DE); Hans-Philipp Reitz, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 442 days.

(21) Appl. No.: 12/085,644

(22) PCT Filed: Oct. 30, 2006

(86) PCT No.: PCT/EP2006/067926

§ 371 (c)(1),
(2), (4) Date: May 27, 2008

(87) PCT Pub. No.: WO2007/062948

PCT Pub. Date: Jun. 7, 2007

(65) Prior Publication Data

US 2009/0267468 A1 Oct. 29, 2009

(30) Foreign Application Priority Data

Nov. 30, 2005 (DE) ..... 10 2005 057 160

(51) Int. Cl.
*F16B 12/00* (2006.01)

(52) U.S. Cl. ..... 312/111; 312/204

(58) Field of Classification Search ..... 312/111, 312/107, 198, 204; 52/287.1, 288.1, 290, 52/716.1, 718.01, 718.04; 403/329; 24/293–295
See application file for complete search history.

(56) References Cited

U.S. PATENT DOCUMENTS

| | | | | |
|---|---|---|---|---|
| 3,392,720 | A * | 7/1968 | Sherman | 126/211 |
| 3,435,574 | A * | 4/1969 | Hallock | 52/278 |
| 3,448,552 | A * | 6/1969 | Schmitt et al. | 52/288.1 |
| 3,696,575 | A * | 10/1972 | Armstrong | 52/288.1 |
| 4,067,155 | A * | 1/1978 | Ruff et al. | 52/105 |
| 5,553,422 | A * | 9/1996 | Gazaway | 52/204.53 |
| 6,820,308 | B1 | 11/2004 | Crittenden | |

FOREIGN PATENT DOCUMENTS

| | | |
|---|---|---|
| DE | 296 21 598 U | 2/1997 |
| EP | 0 441 363 | 8/1991 |

OTHER PUBLICATIONS

International Search Report PCT/EP2006/067926.

* cited by examiner

*Primary Examiner* — Hanh V Tran
(74) *Attorney, Agent, or Firm* — James E. Howard; Andre Pallapies

(57) ABSTRACT

A housing for a household appliance which comprises front and lateral edges on the upper side thereof. At least one securing link can be displaced on at least one of the edges between a position which is adjacent to the housing and a position which is at a distance from the housing.

20 Claims, 2 Drawing Sheets

Fig. 1a
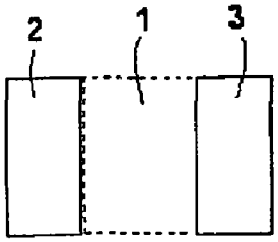
Fig. 1b
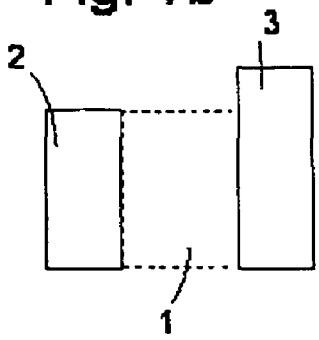
Fig. 1c
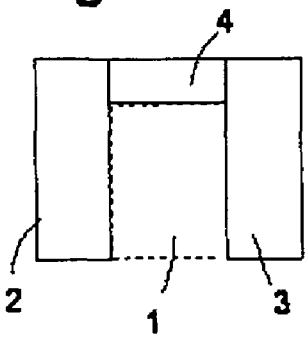
Fig. 2
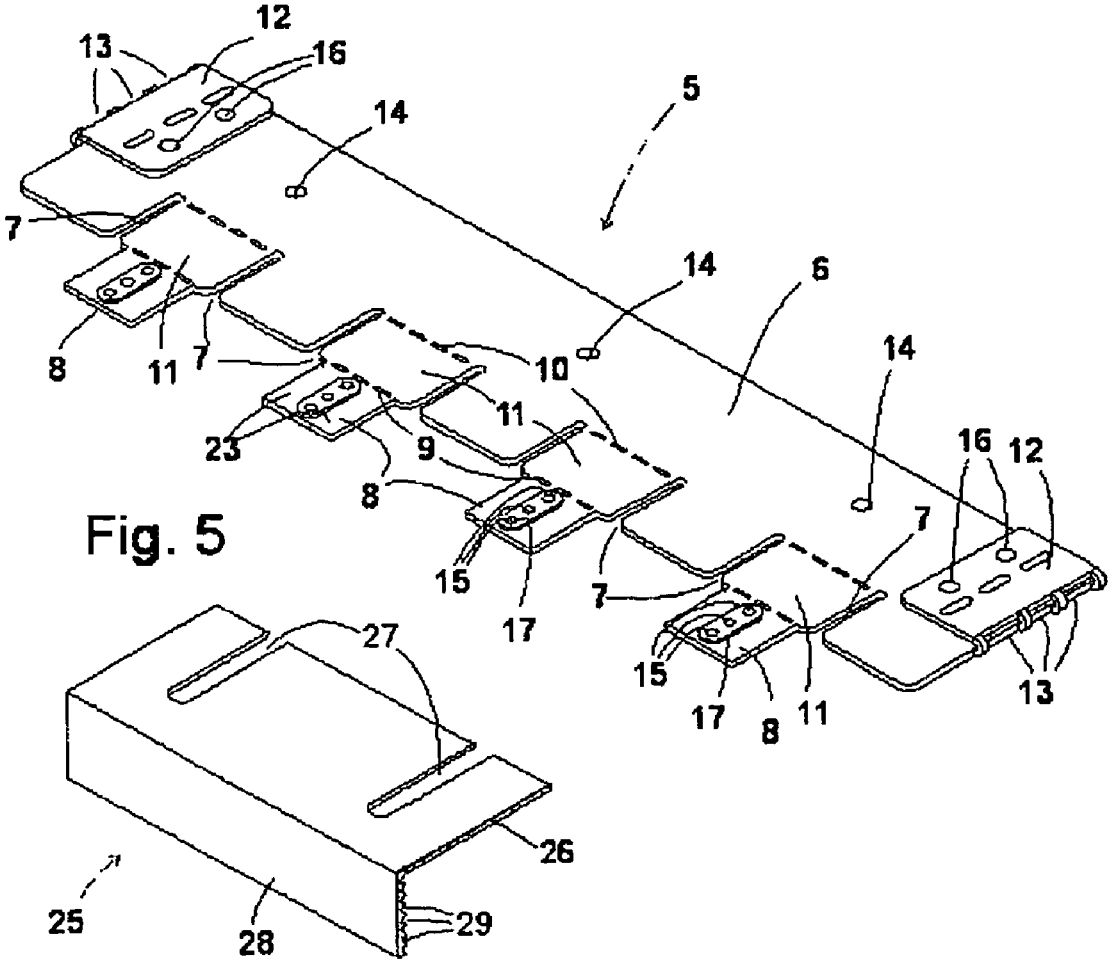
Fig. 5

HOUSING FOR A HOUSEHOLD APPLIANCE

BACKGROUND OF THE INVENTION

The present invention relates to a housing for a household appliance such as, say, a refrigerator or freezer, a dishwasher or washing machine, a tumble dryer or oven which is provided in order to be installed permanently linked to adjacent appliances or kitchen furniture.

Built-in household appliances are generally designed for installation in a recess of a unit of kitchen furniture, said recess having predefined grid dimensions to which the dimensions of the built-in appliance are matched. A small number of connecting points are sufficient in order to fix the built-in appliance in the furniture unit recess. Conventionally, a built-in appliance is secured in the furniture recess with the aid of a plate-shaped bridging part which is mounted on the top of the appliance, which projects beyond a front edge of the appliance carcass, and whose projecting area can be fixed to the ceiling of the furniture recess after the appliance has been installed in position.

Freestanding household appliances are usually not equipped with devices for creating a fixed connection to adjacent appliances or furniture. When such appliances and furniture are placed tightly adjacent to one another, they can shift relative to one another, giving the visual line that they collectively form an untidy, less than attractive appearance. It is therefore inherently desirable in the case of such appliances also to be able to create a fixed connection to adjacent appliances or furniture. However, this is more difficult than in the case of a built-in appliance, since the environment in which an appliance of this kind is installed cannot be standardized in the same way as a furniture recess, but can vary from one situation to the next and make other types of coupling to adjacent furniture or appliances necessary. It is therefore desirable to have a housing for a household appliance which allows a fixed connection to surrounding furniture or devices in different installation situations.

BRIEF SUMMARY OF THE INVENTION

In order to satisfy this requirement, in the case of a housing for a household appliance having a top side which has front and side edges, at least one securing strap can be adjusted at at least one of the edges between a position adjoining the housing and a position projecting from the housing. In the adjoining position the strap is inconspicuous or even invisible to a user if no furniture unit to which the housing is to be connected or could be connected is installed adjacent to said strap; if such a unit of furniture is present, the securing strap can be moved to the position standing out from the housing in order to use it for connecting to the unit of furniture.

Preferably, in particular if the securing strap is disposed at a side edge of the housing, the securing strap can be pivoted about this edge between the adjoining and the projecting position. In this case the projecting position can be in particular a horizontal position in which the securing strap extends onto a furniture unit which is adjacent to the housing and whose height is the same as that of the housing; the projecting position can, however, also be a vertically upright position in which the securing strap touches a sidewall of an adjacent furniture unit which is higher than the housing, and can be fixed to said sidewall.

In the adjoining position the securing strap preferably bears on the top side of the housing. In this way, if it is not used because the adjacent sidewall of the housing is left free, it is practically invisible from the exposed side.

A second type of securing strap is pivotally connected to a spacer which is in turn pivotally connected to the top side of the housing. This permits the securing strap to be adjusted while maintaining its orientation. A strap of this type is suitable in particular for connecting the housing to a furniture unit disposed above it, such as, say, a suspended cabinet.

A strap of this type preferably has a projection on one of its main surfaces, and a screw hole extends through the projection. In this way, if the strap is screwed to a furniture unit and the projection touches the furniture unit, a gap between strap and furniture unit is preserved around the projection.

Said gap can be used to fix therein a first trim profile which conceals the securing strap toward a front side of the housing.

A trim profile of this kind advantageously has a first arm which bears on the securing strap and a slot open at the edge for the purpose of receiving the projection. This enables the trim profile to be inserted subsequently into the gap between strap and furniture unit which remains free around the projection when the latter touches the furniture unit.

A second, vertical arm of the trim profile advantageously has horizontally running grooves. Said grooves can assume a dual function. Firstly, they form weak points of the second arm along which it is easily possible to shorten the vertical arm if the latter is higher than is required to conceal the securing straps and a possible space between the top side of the housing and the furniture unit located above it. Accordingly, a single type of trim profile can be used in order to hide the securing straps and the space between housing top side and furniture unit even though the width of this space may vary considerably from one installation situation to the next.

A second function of the vertical arm and in particular its horizontal grooves is that they can provide a hold for a second cover profile which extends from the second, vertical arm as far as an upper front edge of the carcass and thus also covers the straps toward the bottom.

All the straps are preferably attached to a plate which extends across the top side of a carcass of the housing from one side edge to the other.

The straps and the plate are preferably embodied as a single piece from flat material. In order to be able to adjust the straps, weak points are preferably formed in the flat material between the plate and the straps in each case.

BRIEF DESCRIPTION OF THE DRAWINGS

Further features and advantages of the invention may be derived from the following description of exemplary embodiments with reference to the accompanying figures, in which:

FIGS. 1*a, b* and *c* each show examples of built-in configurations of a household appliance according to the invention;

FIG. 2 shows a perspective view of a plate serving to connect the household appliance to adjacent furniture units;

FIG. 5 shows a perspective view of a cover profile.

DETAILED DESCRIPTION OF THE PRESENT INVENTION

Figure 3:
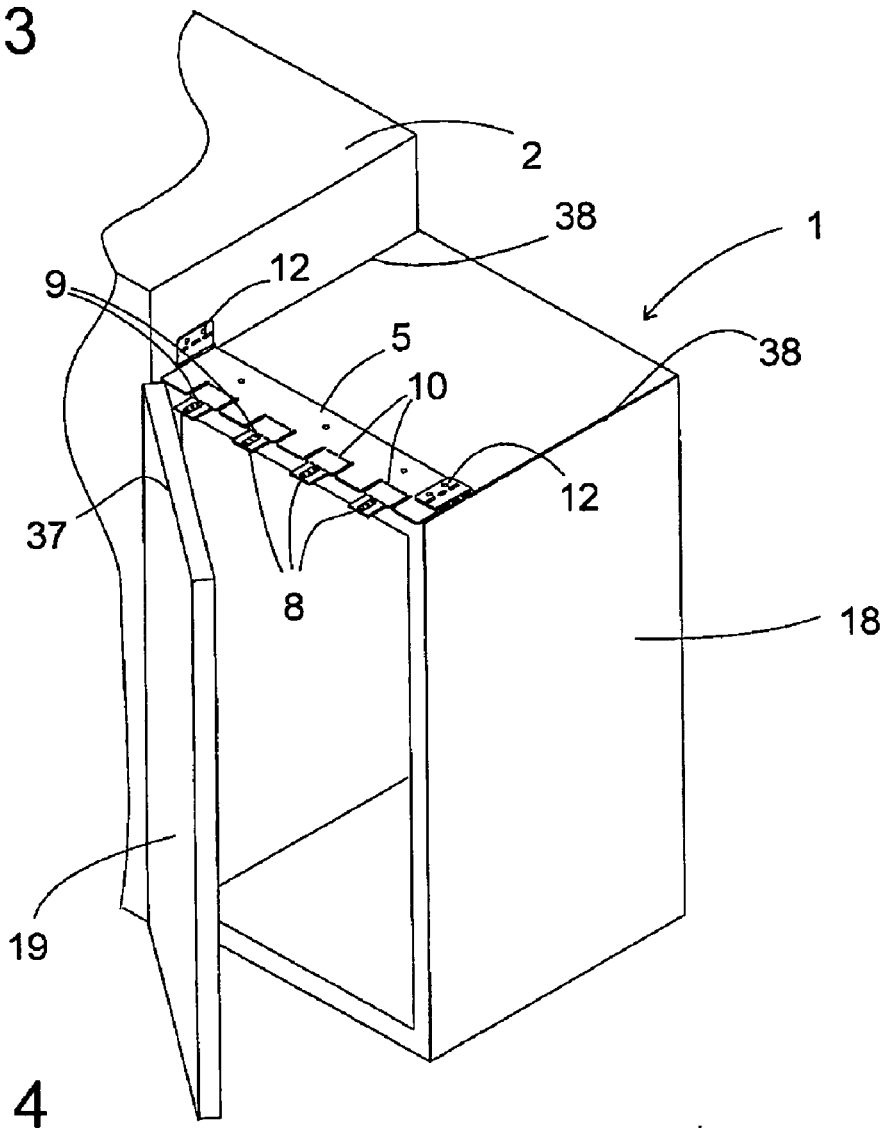
FIG. 3 shows a perspective view of the household appliance with plate mounted on the carcass and connected to an adjacent furniture unit.

When a cabinet-like household appliance such as e.g. a refrigerator or freezer is installed as a freestanding unit between adjacent furniture units, the configurations shown as a schematic front view in each case in FIGS. 1*a*, 1*b*, 1*c* can basically result. When reference is made in the following description to objects installed adjacent to the household appliance according to the invention, they are always referred to as furniture units, though it is of course understood that they can also be other cabinet-shaped household appliances.

FIG. 1*a* shows a configuration in which a household appliance 1, represented as a dashed rectangle, is inserted into a space between furniture units 2, 3, both of which are exactly the same height as the appliance 1 itself. In this case only the top sides of the appliance 1 and the furniture units 2, 3 are accessible for the purpose of establishing thereon a connection between appliance 1 and furniture units 2, 3.

In the configuration shown in FIG. 1*c*, the furniture unit 3 on the right of the household appliance 1 is higher than the unit 2 on the left. A connection of the same type as for the configuration of FIG. 1*a* is not possible in this case, since a connecting device extending to the right from the top side of the household appliance 1 would collide with the furniture unit 3.

In the configuration shown in FIG. 1*c*, the household appliance is inserted into a space which is delimited on the right and left by furniture units 2, 3 which are higher than the appliance 1, and above by a suspended cabinet 4. In this configuration, neither a connection between the top sides of the laterally disposed furniture units 2, 3 and the appliance 1, as considered in the case of FIG. 1A, is possible, nor a connection between the top side of the appliance and a sidewall of the furniture unit, as would come into consideration in the case shown in FIG. 1B.

FIG. 2 shows a perspective view of a connecting plate which, installed on top of the household appliance 1, allows a connection to the adjacent furniture units in all three configurations.

The connecting plate 5 stamped out in a single piece from metal sheet comprises an essentially rectangular baseplate 6 whose width corresponds to that of the household appliance 1. Securing straps 8 project beyond a front edge of the baseplate 6 at equal intervals from one another. Slots 7 are cut into the baseplate 6 on both sides of each securing strap 8. Groups 9, 10 of slotted holes are punched out along the front edge of the baseplate 6 as well as between the ends of two slots 7 adjacent to each other in each case. The slots 7 and the groups of slotted holes 9, 10 in each case delimit spacers 11 which are easily pliable along the groups 9, 10 both in respect of the securing straps 8 and the remainder of the baseplate 6.

Further securing straps 12 are formed at the longitudinal ends of the baseplate 6 and separated from the latter also by groups of slotted holes 13. In the configuration shown in FIG. 2, the securing straps 12 are in each case bent back along the slotted holes 13 onto the top side of the baseplate 6.

Alternatively to the single-part connection between the baseplate 6 and the lateral securing straps 12 shown in the figure, a hinged connection, e.g. of the piano hinge type, would also be suitable.

Holes 14 in the baseplate 6 serve for screwing the connecting plate 5 to the carcass of a household appliance; holes 15, 16 in the securing straps 8, 12 serve for screwing the straps to adjacent furniture units 2, 3, 4, if present. The securing straps 8 each have an elongate, upward-pointing projection 17 in which the holes 15 are formed.

FIG. 3 shows the household appliance 1, a furniture unit 2 set up to the left of the household appliance 1 when viewed from the front, and the connecting plate 5 in a perspective view. The household appliance has a carcass 18 and, attached thereto, a door 19 shown partly open in the figure. The connecting plate 5 is screwed to the top side of the carcass 18 in a position in which the front edge of the baseplate 6 roughly coincides with the top front edge of the carcass 18. The securing straps 8 lie in the same plane as the baseplate 6 and project beyond the front side of the carcass 18, though not so far that they would also project beyond the front edge 37 of the door 19 in its closed position. The baseplate 6 extends from one side edge 38 of the top side of the carcass 18 to the other.

One of the lateral securing straps 12 is pivoted upward through 90° about an axis which essentially coincides with the adjacent edge 38, such that the securing strap 12 butts against the sidewall of the furniture unit 2, and is screwed to the latter so that it fixes the household appliance 1 in relation to the furniture unit 2 in a position in which the door 19, in the closed position, is flush with the front side of the furniture unit 2 or is aligned in some other way as desired.

In order to the connect the household appliance 1 to a furniture unit which is the same height as itself, one of the lateral securing straps 12 can be pivoted out of the position shown in FIG. 2 through 180° into a horizontal position projecting sideways above the carcass 18, in which position it rests on the top side of the furniture unit and can be screwed to the latter from above.

If no furniture unit is installed above the household appliance 1, as shown in FIG. 3, it is possible to fold back the forward-projecting securing straps 8 in each case along the slotted holes 9 or 10 so that the straps 8 come to rest on the baseplate 6 and are then also practically no longer visible from the front when the door 19 is open.

Figure 4:
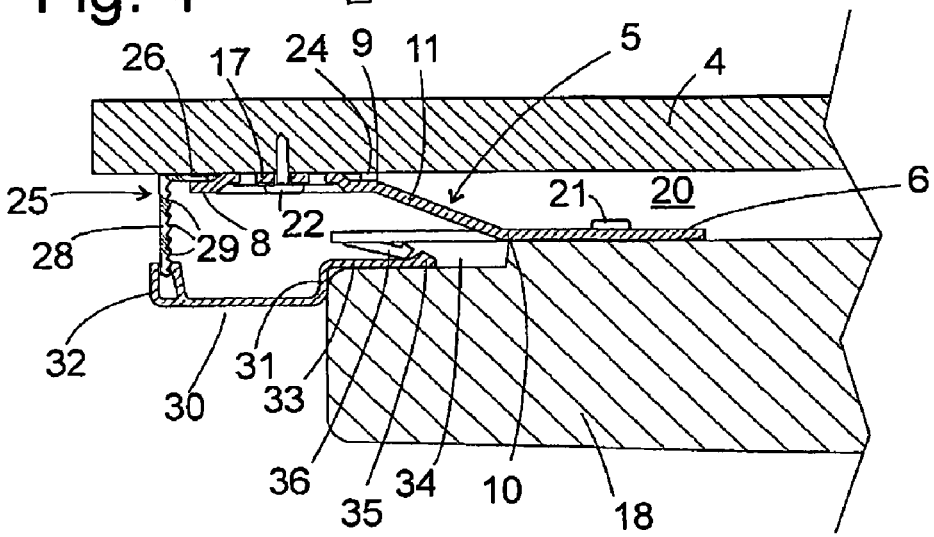
FIG. 4 shows a vertical section through the plate and parts of the refrigeration appliance which are adjacent thereto and a suspended cabinet mounted above it in the built-in configuration of FIG. 1*c*.

The use of the straps 8 for connecting the appliance 1 to a suspended cabinet 4 disposed above it is shown in FIG. 4 with the aid of a vertical section which shows the connecting plate 5 as well as a part of the ceiling of the carcass 18 and the base of the suspended cabinet 4 in each case. Between the two is a gap 20 whose width can vary from one installation situation to the next. The connecting plate 5 is fixed to the carcass 18 by means of screws 21 before the appliance is inserted under the suspended cabinet 4. Starting from this position the securing straps 8 are pressed against the baseplate of the cabinet 4, the material of the connecting plate 5 bending along the groups of slotted holes 9, 10 and the spacer 11 assuming the diagonal course shown in the figure. The projection 17 of the strap 8 is kept pressed against the cabinet 4 by means of a screw 22.

In this case the areas 23 (see FIG. 2) surrounding the projection 17 remain spaced apart from the underside of the cabinet 4 by means of a narrow gap 24. A first cover profile 25 is inserted into this gap. FIG. 5 shows a perspective view of a section of this first cover profile 25. It has an essentially L-shaped cross-section with a horizontal arm 26 into which slots 27 open at the edge are cut at regular intervals. Said slots 27 permit the horizontal arm 26 to be inserted into the gap 24 by receiving the projections 17 of the straps 8 screwed to the cabinet 4. A vertical arm 28 hides the view from the front onto the gap 20 and the connecting plate 5 installed therein.

On its rear facing the carcass 18 the vertical arm 28 is provided with a plurality of horizontally extending grooves 29. Said grooves 29 form weak points along which it is easily possible to shorten the arm 28 by cutting or breaking and thereby adapt it to the width of the gap 20.

Since the securing straps 8 have to project beyond the front side of the carcass 18 so that they can be screwed to the underside of the cabinet 4, the vertical arm 28 of the cover profile 25 cannot touch the carcass 18 and therefore also cannot completely close the gap 20. A second cover profile 30, embodied in this case in the form of a shallow gutter with sidewalls 31, 32, serves this purpose. One of the sidewalls 31 sits against the front side of the carcass 18, and the other 32 contains a groove that is open toward the top and into which the vertical arm 28 engages. In this arrangement the fluted rear of the arm 28 enables the arm 28 to latch in place in the groove.

Projecting horizontally from the sidewall 31 is a web 33 which engages in a gap 34 between the top side of the carcass 18 and the baseplate 6. A bead 35 at the free end of the web 33 is locked in place on latching straps 36 that are unlatched from the baseplate 6.

After the straps 8 have been fastened to the suspended cabinet 4, the two cover profiles 25, 30 enable the gap 20 to be completely hidden with two hand actions, by inserting the profile 25 into the gap 24 surrounding the projections 17 of the straps 8 and subsequently introducing the cover profile 30 into the gap 34 and clipping it onto the vertical arm 28.

The invention claimed is:

1. A housing for a household appliance, the housing comprising:

a top wall that has a front edge and a first side edge; and a connecting plate, the connecting plate having a base plate fixed to an upper surface of the top wall; and a first securing strap connected to the base plate by a first bending section that is less rigid than the first securing strap and is less rigid than the base plate, the first securing strap being pivotable about the first bending section between an adjoining position and a projecting position while the base plate is fixed to the top wall, wherein in the projecting position the first securing strap extends from one of the top wall, the front edge, or the first side edge, and in the adjoining position the first securing strap is positioned parallel to the base plate and does not extend beyond the top wall, does not extend beyond the front edge, and does not extend beyond the first side edge.

2. The housing as claimed in claim 1, wherein the first securing strap is pivotable about the first side edge between the adjoining position and the projecting position.

3. The housing as claimed in claim 1, wherein, in the adjoining position, the first securing strap is parallel to the top wall of the housing and bears on the base plate.

4. The housing as claimed in claim 1 and further comprising a spacer between the base plate and the first securing strap, the spacer being pivotably connected to the base plate and pivotably connected to the first securing strap.

5. The housing as claimed in claim 4, wherein the first securing strap has a main surface, a projection formed on the main surface of the first securing strap, and a screw hole that extends through the projection.

6. The housing as claimed in claim 5, wherein the first securing strap is concealed toward a front side of the housing by means of a trim profile.

7. The housing as claimed in claim 6, wherein a first arm of the trim profile bears on the first securing strap and has a slot that is open at one of the edges for the purpose of receiving the projection.

8. The housing as claimed in claim 6, wherein the trim profile includes horizontally running grooves and an arm that extends vertically.

9. The housing as claimed in claim 1 where the top wall is included on a carcass, the housing further comprising a second securing strap, wherein the base plate extends across the upper surface of the carcass from the first side edge of the housing to a second side edge of the housing, the second side edge of the housing being opposite to the first side edge of the housing, the base plate has a first edge adjacent to the first side edge of the housing, and a second edge adjacent to the second side edge of the housing, the first securing strap is attached to the first edge of the base plate by the first bending section, the second securing strap is connected to the second edge of the base plate by a second bending section that is less rigid than the second securing strap and is less rigid than the base plate, the second securing strap being pivotable about the second bending section between an adjoining position and a projecting position while the base plate is fixed to the top wall, in the projecting position of the second securing strap, the second securing strap extends from the top wall or the second side edge of the housing, in the adjoining position of the second securing strap, the second securing strap is positioned parallel to the base plate and does not extend beyond the top wall, does not extend beyond the front edge, and does not extend beyond the second side edge of the housing.

10. The housing as claimed in claim 9, wherein the securing straps and the base plate are formed from a single piece from flat material, the first bending section is formed in the flat material between the base plate and the first securing strap, and the second bending section is formed in the flat material between the base plate and the second securing strap.

11. The housing as claimed in claim 9, wherein the first bending section includes a first series of holes, and the second bending section includes a second series of holes.

12. The housing as claimed in claim 1, wherein the first bending section includes a series of holes.

13. The housing as claimed in claim 9, further comprising a third securing strap connected to the base plate by a third bending section that is less rigid than the third securing strap and is less rigid than the base plate, the third securing strap being pivotable about the third bending section between an adjoining position and a projecting position while the base plate is fixed to the top wall, in the projecting position of the third securing strap, the third securing strap extends from the top wall or the front edge of the housing, in the adjoining position of the third securing strap, the third securing strap is positioned parallel to the base plate and does not extend beyond the top wall and does not extend beyond the front edge of the housing.

14. A housing for a household appliance, the housing comprising:

a top side that has front and side edges;

at least one securing strap that is adjustable at one of the front and side edges between a position adjoining the housing and a position projecting from the housing, the at least one securing strap structured to include weak points for adjusting the at least one securing strap;

a spacer pivotally connected to the top side and the securing strap respectively;

a cover profile having a pair of sides; and a carcass having a front edge, wherein the securing strap has a main surface, a projection formed on the main surface of the securing strap, and a screw hole that extends through the projection, the securing strap is concealed toward a front side of the housing by means of a trim profile, the trim profile includes horizontally running grooves and an arm that extends vertically, and the cover profile is secured on the arm on one side and on the front edge of the carcass on the other.

15. A household appliance, comprising:

a body of the household appliance, the body having a top wall that has a front edge and a first side edge; and a connecting plate, the connecting plate having a base plate fixed to the top wall of the body; and a first securing strap connected to the base plate by a bending section that is less rigid than the first securing strap and is less rigid than the base plate, the first securing strap being pivotable about the bending section between an adjoining position and a projecting position while the base plate is fixed to the top wall of the body, wherein in the projecting position the first securing strap extends from one of the top wall, the front edge, or the first side edge, and in the adjoining position the first securing strap is positioned parallel to the base plate and does not extend beyond the top wall and does not extend beyond the first side edge.

16. The household appliance as claimed in claim 15, further comprising a second securing strap, wherein the base plate extends across the top wall of the body from the first side edge of the body to a second side edge of the body, the second side edge of the body being opposite to the first side edge of the body, the base plate has a first edge adjacent to the first side edge of the body, and a second edge adjacent to the second side edge of the body, the first securing strap is attached to the first edge of the base plate by the first bending section, the second securing strap is connected to the second edge of the base plate by a second bending section that is less rigid than the second securing strap and is less rigid than the base plate, the second securing strap being pivotable about the second bending section between an adjoining position and a projecting position while the base plate is fixed to the top wall of the body, in the projecting position of the second securing strap, the second securing strap extends from the top wall or the second side edge of the body, and in the adjoining position of the second securing strap, the second securing strap is positioned parallel to the base plate and does not extend beyond the top wall, does not extend beyond the front edge, does not extend beyond the first side edge, and does not extend beyond the second side edge of the body.

17. The household appliance as claimed in claim 16, further comprising a third securing strap connected to the base plate by a third bending section that is less rigid than the third securing strap and is less rigid than the base plate, the third securing strap being pivotable about the third bending section between an adjoining position and a projecting position while the base plate is fixed to the top wall of the body, in the projecting position of the third securing strap, the third securing strap extends from the top wall or the front edge of the body, in the adjoining position of the third securing strap, the third securing strap is positioned parallel to the base plate and does not extend beyond the top wall, does not extend beyond the front edge, does not extend beyond the first side edge, and does not extend beyond the second side edge of the body.

18. The household appliance as claimed in claim 15, wherein the first securing strap is pivotable about the first side edge between the adjoining position of the first securing strap and the projecting position of the first securing strap.

19. The household appliance as claimed in claim 15, wherein, in the adjoining position of the first securing strap, the first securing strap is parallel to the top wall of the body and bears on the base plate.

20. The household appliance as claimed in claim 17, further comprising a spacer between the base plate and the third securing strap, the spacer being pivotably connected to the third securing strap by the third bending section and pivotably connected to the base plate by a fourth bending section.

* * * * *